US010535258B2

(12) United States Patent
Jin et al.

(10) Patent No.: US 10,535,258 B2
(45) **Date of Patent: *Jan. 14, 2020**

(54) TRAFFIC VOLUME DETERMINATION SYSTEM, TRAFFIC VOLUME DETERMINATION METHOD, AND NON-TRANSITORY COMPUTER-READABLE STORAGE MEDIUM STORING TRAFFIC VOLUME DETERMINATION PROGRAM

(71) Applicant: TOYOTA JIDOSHA KABUSHIKI KAISHA, Toyota-shi, Aichi-ken (JP)

(72) Inventors: Xin Jin, Nagoya (JP); Toshinori Takayama, Tokyo (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/360,709

(22) Filed: Mar. 21, 2019

(65) Prior Publication Data

US 2019/0221112 A1 Jul. 18, 2019

Related U.S. Application Data

(63) Continuation of application No. 16/106,660, filed on Aug. 21, 2018, now Pat. No. 10,282,983.

(30) Foreign Application Priority Data

Sep. 15, 2017 (JP) ..... 2017-177690

(51) Int. Cl.
*G08G 1/01* (2006.01)

(52) U.S. Cl.
CPC ..... *G08G 1/0133* (2013.01); *G08G 1/0129* (2013.01)

(58) Field of Classification Search
None
See application file for complete search history.

(56) References Cited

U.S. PATENT DOCUMENTS

| | | | | |
|---|---|---|---|---|
| 2007/0032946 A1 | 2/2007 | Goto et al. | | |
| 2007/0208495 A1* | 9/2007 | Chapman | G08G 1/0104 | 701/117 |
| 2007/0208496 A1* | 9/2007 | Downs | G08G 1/0112 | 701/117 |

FOREIGN PATENT DOCUMENTS

| | | |
|---|---|---|
| JP | 2005-284588 A | 10/2005 |
| JP | 2007-041294 A | 2/2007 |
| JP | 2014-241090 A | 12/2014 |

* cited by examiner

*Primary Examiner* — Julie B Lieu
(74) *Attorney, Agent, or Firm* — Hunton Andrews Kurth LLP

(57) ABSTRACT

A traffic volume determination system includes a processor configured to: calculate, while taking account of a change between a past traffic volume and a current traffic volume of vehicles passing through an area around a link, an estimated value of the current traffic volume of the vehicles passing through the link from the past traffic volume of the vehicles passing through the link; and determine that the link is closed when a current actual traffic volume of the vehicles passing through the link is smaller than the estimated value of the current traffic volume of the vehicles passing through the link by more than a statistical error.

6 Claims, 4 Drawing Sheets

TRAFFIC VOLUME DETERMINATION SYSTEM, TRAFFIC VOLUME DETERMINATION METHOD, AND NON-TRANSITORY COMPUTER-READABLE STORAGE MEDIUM STORING TRAFFIC VOLUME DETERMINATION PROGRAM

INCORPORATION BY REFERENCE

This is a continuation application of U.S. patent application Ser. No. 16/106,660, filed Aug. 21, 2018 claiming the disclosure of Japanese Patent Application No. 2017-177690 filed on Sep. 15, 2017 including the specification, drawings and abstract and is incorporated herein by reference in its entirety.

BACKGROUND

1. Technical Field

The disclosure relates to a traffic volume determination system, a traffic volume determination method, and a non-transitory computer-readable storage medium storing a traffic volume determination program.

2. Description of Related Art

With the advancement of road-to-vehicle communication technology, collection of probe data by in-vehicle devices of vehicles traveling on roads has enabled sequential accumulation of large amounts of traffic data with high precision. Accordingly, from time-series analyzation of the probe data for each road section, it is possible to find out an average traffic volume and a moving history of a vehicle. In view of the above trends, Japanese Unexamined Patent Application Publication No. 2014-241090 (JP 2014-241090 A) discloses a technology for detecting a traffic restriction and a release of the restriction of a road based on probe data representing a traveling trajectory of a vehicle. Japanese Unexamined Patent Application Publication No. 2005-284588 (JP 2005-284588 A) discloses a technology for matching a traveling trajectory of a vehicle obtained from probe data to a link on a map database, counting the number of vehicles that pass through for each of the matched links for a plurality of the vehicles, and determining that a traffic restriction has been imposed on the link where the number of vehicles that pass through is lower than a threshold. Japanese Unexamined Patent Application Publication No. 2007-41294 (JP 2007-41294 A) discloses a technology for detecting a newly closed road from a difference between a distribution map of past traveling position data of a vehicle, which has been created using probe data with different collection periods, and a distribution map of future traveling position data of the vehicle.

SUMMARY

However, it is difficult to properly determine whether or not a given road is closed to vehicles in the technologies disclosed in JP 2014-241090 A, JP 2005-284588 A, and JP 2007-41294 A. This is because, in a case where a situation in which no vehicle travels on the given road occurs routinely at a specific time slot, determination cannot be made that the given road is closed just by the fact that the traffic volume at the specific time slot is zero. Whether or not a situation in which no vehicle travels can occur routinely on a given road at the specific time slot may vary from road to road and from day to day, even on the same road. The traffic volume of the given road is also affected by a presence or absence of an event at an area around the given road. It is desirable to determine whether or not the given road is closed to vehicles in consideration of the above described circumstances.

The disclosure provides a traffic volume determination system, a traffic volume determination method, and a non-transitory computer-readable storage medium storing a traffic volume determination program, which are capable of properly determining whether or not a link on a map database (hereinafter referred to as "link") is closed to vehicles.

A first aspect of the disclosure relates to a traffic volume determination system including a processor. The processor is configured to calculate, while taking account of a change between a past traffic volume and a current traffic volume of vehicles passing through an area around a link, an estimated value of the current traffic volume of the vehicles passing through the link from the past traffic volume of the vehicles passing through the link. The processor is configured to determine that the link is closed when a current actual traffic volume of the vehicles passing through the link is smaller than the estimated value of the current traffic volume of the vehicles passing through the link by more than a statistical error.

In the traffic volume determination system according to the first aspect of the disclosure, the processor may be configured to multiply a ratio of the current traffic volume of the vehicles passing through the area to the past traffic volume of the vehicles passing through the area by the past traffic volume of the vehicles passing through the link to calculate the estimated value of the current traffic volume of the vehicles passing through the link.

A second aspect of the disclosure relates to a traffic volume determination method. The traffic volume determination method includes calculating, while taking account of a change between a past traffic volume and a current traffic volume of vehicles passing through an area around a link, an estimated value of the current traffic volume of the vehicles passing through the link from the past traffic volume of the vehicles passing through the link, by a computer system, and determining that the link is closed when a current actual traffic volume of the vehicles passing through the link is smaller than the estimated value of the current traffic volume of the vehicles passing through the link by more than a statistical error, by the computer system.

A third aspect of the disclosure relates to a non-transitory computer-readable storage medium storing a traffic volume determination program. The traffic volume determination program causes a computer system to execute steps of calculating, while taking account of a change between a past traffic volume and a current traffic volume of vehicles passing through an area around a link, an estimated value of the current traffic volume of the vehicles passing through the link from the past traffic volume of the vehicles passing through the link; and determining that the link is closed when a current actual traffic volume of the vehicles passing through the link is smaller than the estimated value of the current traffic volume of the vehicles passing through the link by more than a statistical error.

According to the aspects of the disclosure, it is possible to properly determine whether or not a link is closed to vehicles.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
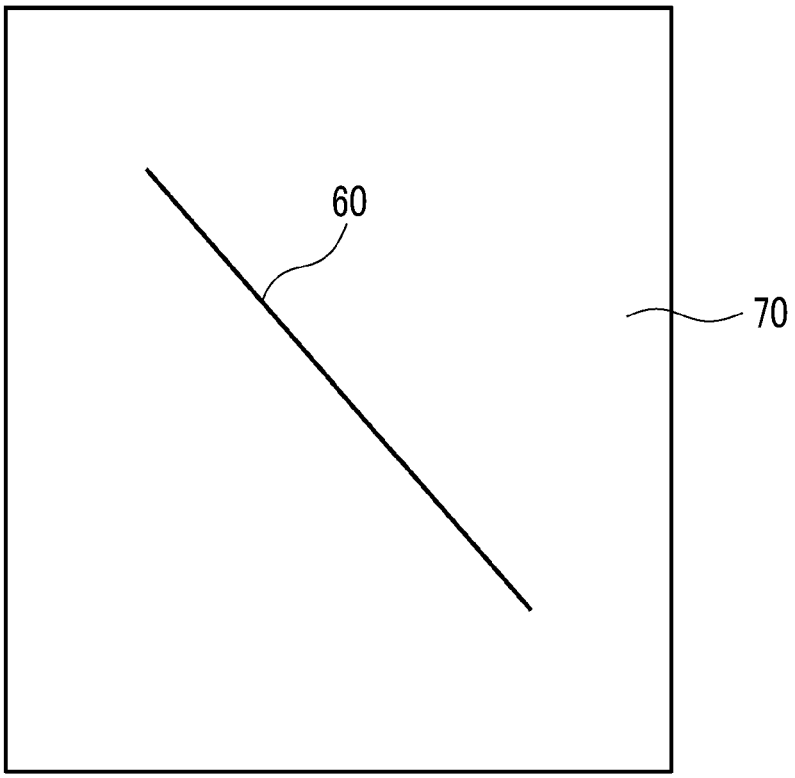
FIG. 1 is a graph showing a relationship between a link and an area around the link according to an embodiment of the disclosure.

Hereinafter, an embodiment of the disclosure will be described with reference to the drawings. In the following description, the same reference numerals denote the same components, and redundant descriptions are omitted. FIG. 1 is a graph showing a relationship between a link 60 and an area 70 around the link 60 according to an embodiment of the disclosure. The link 60 is defined corresponding to a road section and is a vector starting from a predetermined point on the road (for example, a predetermined intersection point) and ending at another point on the road (for example, another intersection point). On a two-way road, two links with different traffic directions in the same section are defined. In the area 70, road map information is shown, which is divided into regions called meshes, and the road map information includes information relating to a connection relationship between a plurality of links. The link 60 is one of the links included in the road map information. A contour of the area 70 may be, for example, a square with a side that represents several kilometers in length.

Figure 2:
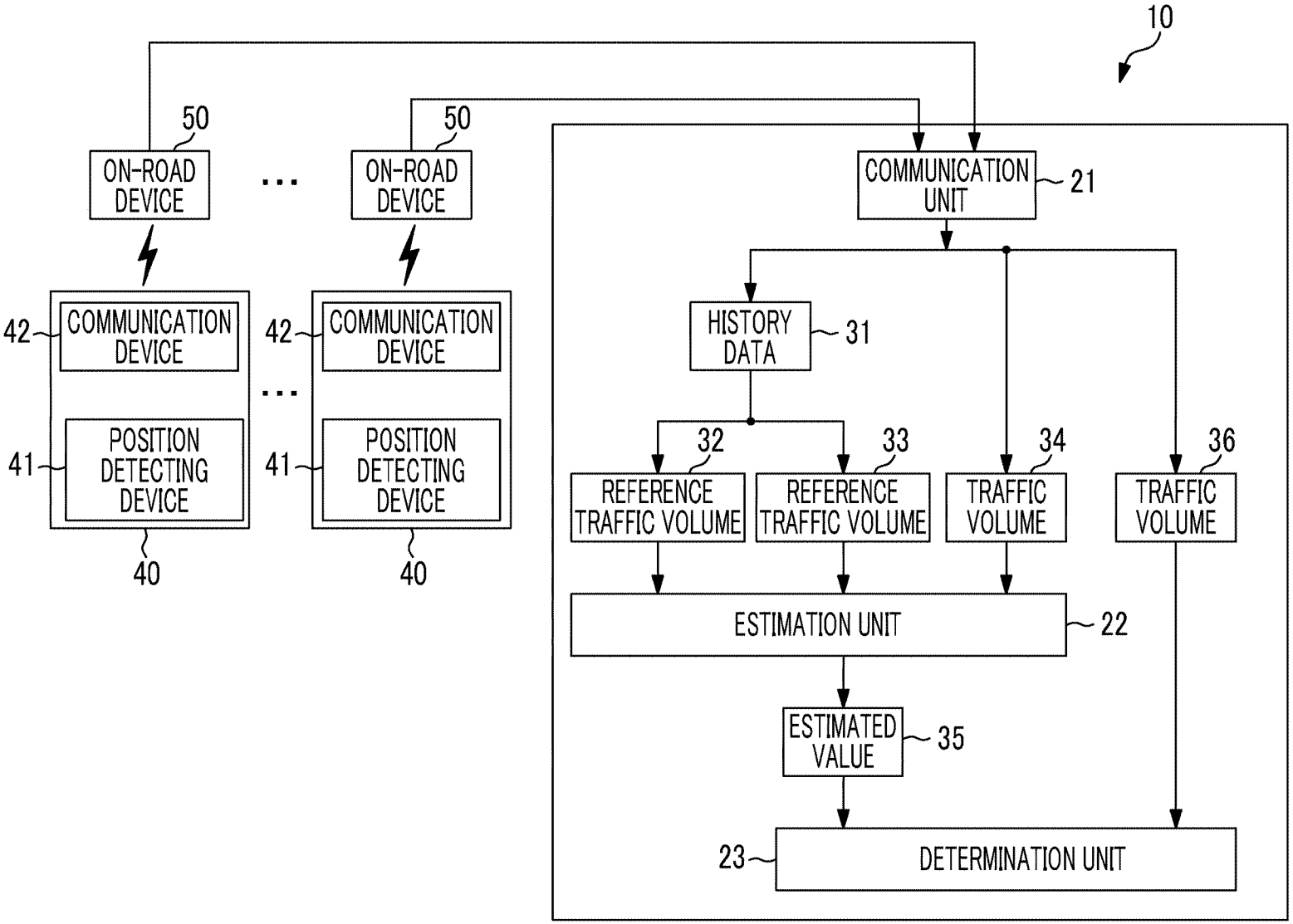
FIG. 2 is an explanatory diagram showing a functional block of a traffic volume determination system according to the embodiment of the disclosure.

FIG. 2 is an explanatory diagram showing a functional block of a traffic volume determination system 10 according to the embodiment of the disclosure. The traffic volume determination system 10 is a computer system that determines traffic volume on the road based on probe data acquired from a plurality of vehicles 40. Each of the vehicles 40 has a position detecting device 41 for detecting the position of the own vehicle and a communication device 42 for wirelessly transmitting the probe data to on-road devices 50. The probe data contains position information, speed information, and time information of each of the vehicles 40, and each of the vehicles 40 that wirelessly transmits the probe data described above is called a probe car. The position detecting device 41 is, for example, a global positioning system (GPS). The road-to-vehicle communication method between the communication device 42 and the on-road device 50 is, for example, an optical beacon, a wireless local area network (LAN), or a dedicated short range communication (DSRC).

Some on-road devices 50 among a plurality of the on-road devices 50 are disposed along the link 60, while the other on-road devices 50 are disposed along links (not shown) other than the link 60 in the area 70. The traffic volume determination system 10 collects the probe data received from the vehicles 40 by each of the on-road devices 50, and acquires the information about the traffic volume of the vehicles 40 passing through the link 60 and the information about the traffic volume of the vehicles 40 passing through the area 70 (all links other than the link 60 in the area 70). Since the on-road devices 50 are not indispensable, the traffic volume determination system 10 may receive the probe data from the vehicles 40 through wireless communication (for example, a mobile phone line or a dedicated line).

The traffic volume determination system 10 includes a communication unit 21, an estimation unit 22, and a determination unit 23. The traffic volume determination system 10 includes a processor, a storage resource, and a communication interface as the hardware resources. The storage resource is a storage area of a computer-readable recording medium (for example, a hard disk drive, a solid-state drive, a memory card, an optical disk drive, or a semiconductor memory). A traffic volume determination program that controls an operation of the traffic volume determination system 10 is stored, in the storage resource. The traffic volume determination program is a computer program causing the traffic volume determination system 10 to execute a process of steps 301 to 305 shown in FIG. 3. The functions of the communication unit 21, the estimation unit 22, and the determination unit 23 are realized in cooperation with hardware resources of the traffic volume determination system 10 and the traffic volume determination program. The functions similar to those of the estimation unit 22 and the determination unit 23 may be realized by using a dedicated hardware resource (for example, an application specific integrated circuit (ASIC)) or a firmware.

The communication unit 21 receives the probe data wirelessly transmitted from the vehicles 40, and stores the received probe data as history data 31 in the storage resource. The history data 31 includes history information relating to the traffic volume of the vehicles 40 passing through the link 60 for a certain period of time from the past to the present and history information relating to the traffic volume of the vehicles 40 passing through the area 70 for a certain period of time from the past to the present. The processor calculates, from the history data 31, an average value of the traffic volume of the link 60 per time slot (except for the exceptional traffic volume fluctuation caused by accidents and the like) for each day of the week, and stores the average value of the calculated traffic volume as a reference traffic volume 32 of the link 60 in the storage resource. The reference traffic volume 32 of the link 60 may vary from time slot to time slot even on the same day of the week, and may also vary from day to day even in the same time slot. The processor also calculates the reference traffic volume 32 for each of links other than the link 60 in the area 70. The processor calculates the average value of the traffic volume for each time slot of the area 70 (except for the exceptional traffic volume fluctuation caused by accidents) from the history data 31 for each day of the week, and stores the average value of the calculated traffic volume as a reference traffic volume 33 of the area 70 in the storage resource. The reference traffic volume 33 of the area 70 may vary from time slot to time slot on the same day of the week, and may also vary from day to day even in the same time slot.

The estimation unit 22 takes account of the change between the past traffic volume and the current traffic volume of the vehicles 40 passing through the area 70 around the link 60 and calculates an estimated value 35 of the current traffic volume of the vehicles 40 passing through the link 60 from the past traffic volume of the vehicles 40 passing through the link 60. Specifically, the estimation unit 22 multiplies a ratio (for example, a traffic volume 34/the reference traffic volume 33) of the current actual traffic volume 34 of the vehicles 40 passing through the area 70 to the past traffic volume of the vehicles 40 passing through the area 70 (for example, the reference traffic volume 33 of the area 70 at the time in the past, which is the same as the current time), by the past traffic volume of the vehicles 40 passing through the link 60 (for example, the reference traffic volume 32 of the link 60 at the time in the past, which is the same as the current time) and calculates the estimated value 35 of the current traffic volume of the vehicles 40 passing through the link 60 (for example, estimated value 35=reference traffic volume 32×traffic volume 34/reference traffic volume 33). As described above, by taking account of the change between the past traffic volume and the current traffic volume of the vehicles 40 passing through the area 70 around the link 60, it is possible to properly estimate the current traffic volume of the vehicles 40 passing through the link 60. For example, even though it is assumed that the traffic volume of the link 60 decreases at a predetermined time slot, in a case where the traffic volume at the same time slot of the area 70 around the link 60 also decreases due to traffic restrictions accompanying the holding of an event or the like, the decrease in the traffic volume described above is a natural traffic phenomenon. Therefore, it is appropriate to estimate the traffic volume of the link 60 taking account of the rate of the decrease in the traffic volume of the area 70. As described above, it is possible to further suppress erroneous determination caused by a simple determination that the decrease in the traffic volume of the link 60 is due to the closing of the link 60 without taking account of the change between the past traffic volume and the current traffic volume of the vehicles 40 passing through the area 70. On the other hand, in a case where the traffic volume on the link 60 decreases compared to that of the area 70, there may be a possibility that the link 60 is closed, regardless of whether the traffic volume of the area 70 around the link 60 increases or remains almost unchanged.

The determination unit 23 determines that the link 60 is closed when a current actual traffic volume 36 of the vehicles 40 passing through the link 60 is smaller than the estimated value 35 of the current traffic volume of the vehicles 40 passing through the link 60 by more than a statistical error. In a case where the distribution of errors between the traffic volume 36 and the estimated value 35 follows a normal distribution, approximately 95.5% of the estimated value 35 can be considered to be distributed within the range of twice the standard deviation. For this reason, more than the statistical error can be interpreted, for example, to mean being more than twice the standard deviation. However, the interpretation of the statistical error is not limited to the above example, and other statistically valid interpretations may be used.

Figure 3:
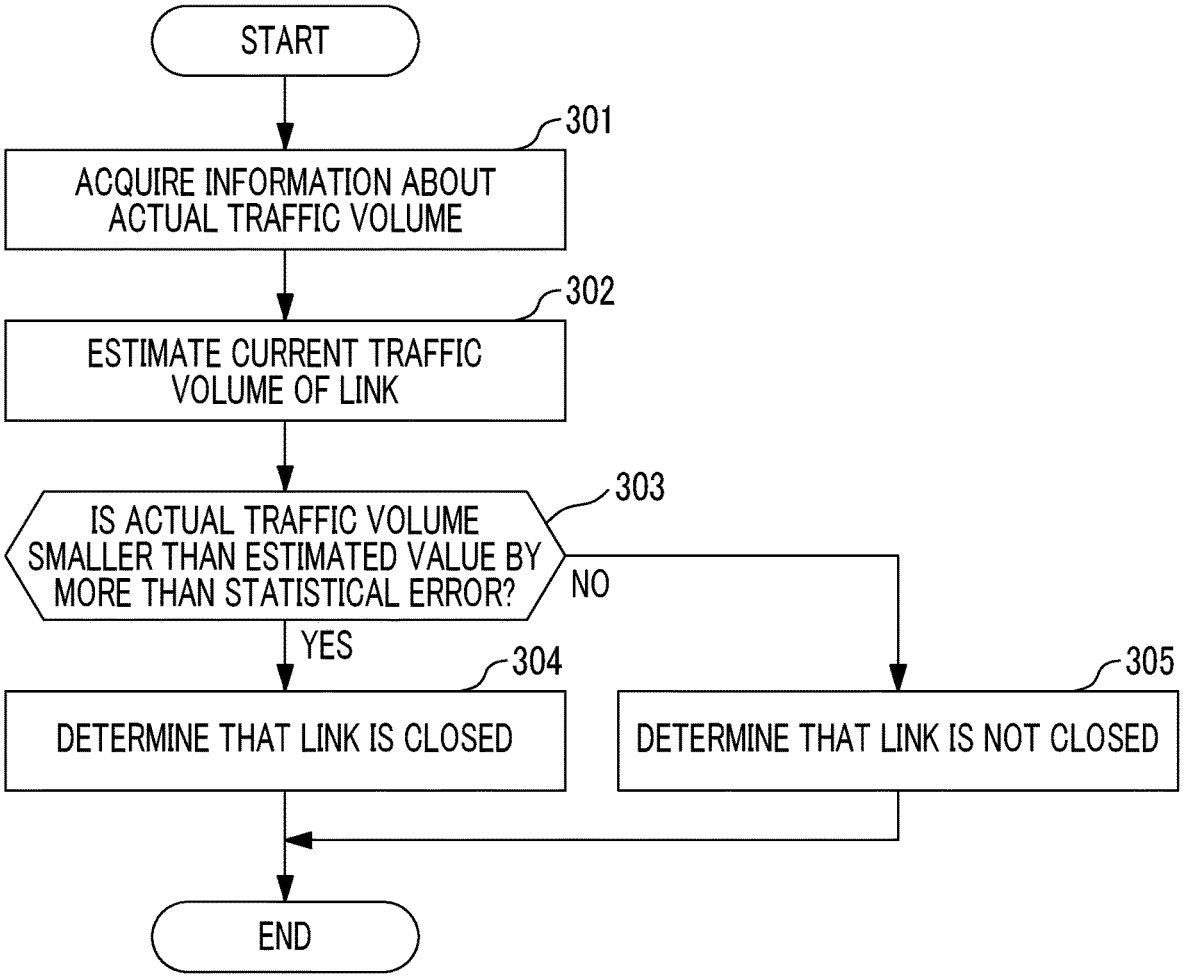
FIG. 3 is a flowchart showing a flow of a process of a traffic volume determination method according to the embodiment of the disclosure.

FIG. 3 is a flowchart showing a flow of a process of a traffic volume determination method according to the embodiment of the disclosure. Prior to processing of step 301, it is assumed that the history data 31 is stored in the storage resource of the traffic volume determination system 10, and the reference traffic volumes 32, 33 are calculated from the history data 31 in advance. The communication unit 21 acquires information about the current actual traffic volume 34 of the vehicles 40 passing through the area 70 and information about the current actual traffic volume 36 of the vehicles 40 passing through the link 60, from the probe data (step 301). The estimation unit 22 takes account of the change between the past traffic volume and the current traffic volume of the vehicles 40 passing through the area 70 around the link 60 and calculates the estimated value 35 of the current traffic volume of the vehicles 40 passing through the link 60 from the past traffic volume of the vehicles 40 passing through the link 60 (step 302). The determination unit 23 determines whether or not the traffic volume 36 is smaller than the estimated value 35 by more than the statistical error (step 303). In a case where the traffic volume 36 is smaller than the estimated value 35 by more than the statistical error (step 303: YES), the determination unit 23 determines that the link 60 is closed (step 304). In other cases, that is, in cases where the traffic volume 36 is not smaller than the estimated value 35, or is smaller than the estimated value 35 but is not smaller by more than the statistical error (step 303: NO), the determination unit 23 determines that the link 60 is not closed (step 305).

Figure 4:
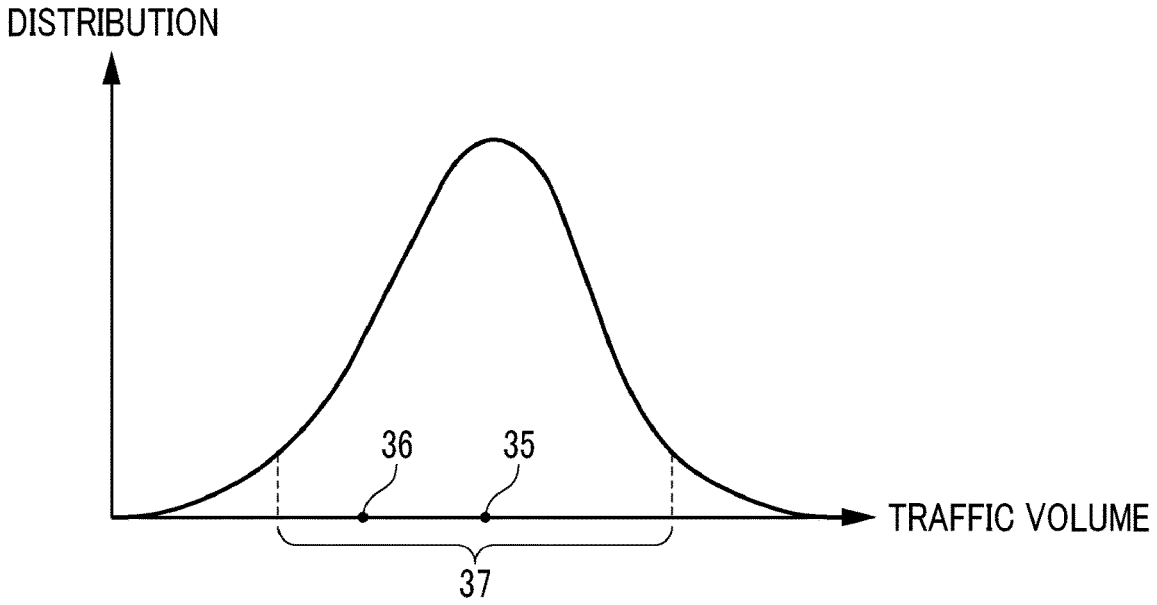
FIG. 4 is a graph showing a specific example of determining a closing of the link according to the embodiment of the disclosure.

Here, with reference to FIG. 4, a specific example of determining the closing of the link 60 will be described. For example, the reference traffic volume 33 of the area 70 at a time in the past, which is the same as the current time, is set to 7 vehicles/5 minutes, and the current actual traffic volume 34 of the vehicles 40 passing through the area 70 is set to 1.4 vehicles/5 minutes. In this case, since the current actual traffic volume 34 of the vehicles 40 passing through the area 70 is 20% (=1.4/7×100%) of the reference traffic volume 33, the current traffic volume of the entire area 70 decreases to 20% compared to that of the time in the past, which is the same as the current time. When the reference traffic volume 32 of the link 60 at the time in the past, which is the same as the current time, is set to 10 vehicles/5 minutes, the estimated value 35 of the current traffic volume of the vehicles 40 passing through the link 60 is 2 vehicles/5 minutes (=10/5 minutes×0.2). When it is assumed that the current actual traffic volume 36 of the vehicles 40 passing through the link 60 is 1 vehicle/5 minutes, the difference between the estimated value 35 and the traffic volume 36 is within the range of a statistical error 37, and thus determination is made that the link 60 is not closed.

Figure 5:
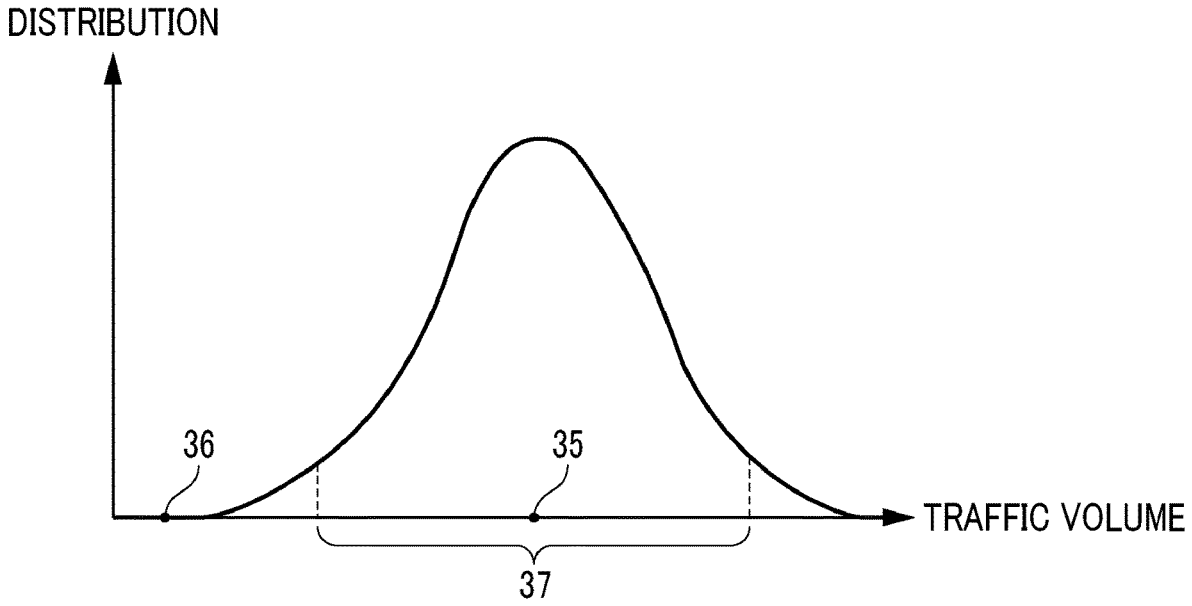
FIG. 5 is a graph showing another specific example of determining the closing of the link according to the embodiment of the disclosure.

With reference to FIG. 5, another specific example for determining the closing of the link 60 will be described. For example, the reference traffic volume 33 of the area 70 at the time in the past, which is the same as the current time, is set to 7 vehicles/5 minutes, and the current actual traffic volume 34 of the vehicles 40 passing through the area 70 is set to 7.7 vehicles/5 minutes. In this case, since the current actual traffic volume 34 of the vehicles 40 passing through the area 70 is 110% (=7.7/7×100%) of the reference traffic volume 33, the current traffic volume of the entire area 70 increases to 110% compared to that of the time in the past, which is the same as the current time. When the reference traffic volume 32 of the link 60 at the time in the past, which is the same as the current time, is set to 10 vehicles/5 minutes, the estimated value 35 of the current traffic volume of the vehicles 40 passing through the link 60 is 11 vehicles/5 minutes (=10/5 minutes×1.1). When the current actual traffic volume 36 of the vehicles 40 passing through the link 60 is 0 vehicles/5 minutes, the traffic volume 36 is smaller than the estimated value 35 by more than the statistical error 37, and thus determination is made that the link 60 is closed.

According to the present embodiment, by calculating, while taking account of the change between the past traffic volume and the current traffic volume of the area 70 around the link 60, the estimated value 35 of the current traffic volume of the link 60, it is possible to further suppress erroneous determination as to whether or not the link 60 is closed.

The method of measuring the traffic volume of the link 60 or the area 70 is not limited to the method of acquiring the probe data from the vehicles 40, and may be a known method (for example, a method of using image recognition, laser level sensor, ultrasonic sensor, or loop coil).

The above described embodiment is to facilitate the understanding of the disclosure, and is not intended to be construed as limiting the disclosure. The disclosure can be modified or improved without departing from the spirit of the disclosure, and the disclosure includes equivalents thereof. That is, those in which design modifications are appropriately made to the embodiment by those skilled in the art are also included in the scope of the disclosure as long as they have the features of the disclosure. Each element included in the embodiment can be combined as far as technically possible and the combination of these elements is also within the scope of the disclosure as long as the features of the disclosure are included.

What is claimed is:

1. A traffic information system comprising a processor configured to:

determine that a link is closed when a current traffic volume of the vehicles passing through the link is smaller than an estimated value of the current traffic volume of the vehicles passing through the link by more than a statistical error defined in statistical information wherein the statistical information is generated from the estimated value of the current traffic volume of the vehicles passing through the link and the past traffic volume of the vehicles passing through the link.

2. The traffic information system according to claim 1, wherein the processor is configured to estimate the current traffic volume of the vehicles passing through the link from the past traffic volume of the vehicles.

3. The traffic information system according to claim 1, wherein the processor is configured to multiply a ratio of the current traffic volume of the vehicles passing through the area to the past traffic volume of the vehicles passing through the area by the past traffic volume of the vehicles passing through the link to calculate the estimated value of the current traffic volume of the vehicles passing through the link.

4. A traffic information determination method comprising:

determining that a link is closed when a current traffic volume of the vehicles passing through the link is smaller than an estimated value of the current traffic volume of the vehicles passing through the link by more than a statistical error defined in statistical information, by a processor, wherein the statistical information is generated from the estimated value of the current traffic volume of the vehicles passing through the link and the past traffic volume of the vehicles passing through the link.

5. The traffic information determination method according to claim 4, further comprising estimating the current traffic volume of the vehicles passing through the link from the past traffic volume of the vehicles, by the processor.

6. The traffic information determination method according to claim 4, further comprising multiplying a ratio of the current traffic volume of the vehicles passing through the area to the past traffic volume of the vehicles passing through the area by the past traffic volume of the vehicles passing through the link to calculate the estimated value of the current traffic volume of the vehicles passing through the link, by the processor.

* * * * *